United States Patent [19]

Ferwagner

[11] 4,192,170

[45] Mar. 11, 1980

[54] DRAWING DIE FOR MAKING A PIPE ELBOW

[76] Inventor: Josef Ferwagner, Hofleite 8, 4630 Bochum, Fed. Rep. of Germany

[21] Appl. No.: 968,865

[22] Filed: Dec. 12, 1978

[30] Foreign Application Priority Data

Dec. 23, 1977 [DE] Fed. Rep. of Germany ..... 2757658

[51] Int. Cl.[2] ..... B21D 11/20

[52] U.S. Cl. ..... 72/414; 72/344; 72/368; 72/475

[58] Field of Search ..... 72/414, 413, 415, 475, 72/368, 343, 344, 367

[56] References Cited

U.S. PATENT DOCUMENTS

| | | | |
|---|---|---|---|
| 35,496 | 6/1862 | Montgomery | 72/414 |
| 170,051 | 11/1875 | Butler | 72/414 |
| 305,707 | 9/1884 | Norwood | 72/413 |
| 316,820 | 4/1885 | Pessenger | 72/413 |
| 2,280,359 | 4/1842 | Trudell | 72/413 |
| 2,466,272 | 4/1949 | Porter | 72/475 |

FOREIGN PATENT DOCUMENTS 1953387 5/1973 Fed. Rep. of Germany .

*Primary Examiner*—Francis S. Husar
*Assistant Examiner*—Gene P. Crosby
*Attorney, Agent, or Firm*—Karl F. Ross

[57] ABSTRACT

A die assembly for making tubing-elbow halves comprises an upper die half having an upper arcuate relatively long holder, a plurality of relatively short and arcuate upper die sections secured in an upper row to this upper holder and having arcuate and downwardly convex lower faces together forming an elongated and substantially continuous downwardly convex arcuate lower surface, and an upper end section at each end of the upper row and each having a generally semicylindrical downwardly convex face forming a continuation of the lower surface. This assembly also has a lower die half having a lower arcuate relatively long U-section holder, a plurality of arcuate lower die sections complementary to the upper arcuate die sections, and a lower end section at each end of the lower row of lower die sections and each having a generally semicylindrical upwardly concave face forming a continuation of the upper surface of the row of lower arcuate die sections. The upper sections are receivable within the lower sections to draw a flat piece of metal into an upwardly concave shape suitable for welding to another such element for forming of a tubing elbow. Moving of some of the arcuate die sections in each holder and rearranging of the end sections allows tubing elbows of various lengths to be produced.

10 Claims, 5 Drawing Figures

DRAWING DIE FOR MAKING A PIPE ELBOW

FIELD OF THE INVENTION

The present invention relates to a die for making a pipe elbow. More particularly this invention concerns a drawing die assembly for making tubing-elbow halves.

BACKGROUND OF THE INVENTION

It is known to make a tubing elbow by separately deep-drawing each of two identical metal plates between an upwardly concave lower die assembly and a downwardly convex upper die assembly. The two plates are identically deformed between the two die assemblies so that each becomes an upwardly open trough arcuate in a horizontal plane. One of these troughs is reversed and placed on top of the other trough, so as to open downwardly against it, and the mating edges are welded together. This method is described in German Pat. No. 1,953,387.

Normally the die havles each have a single integral piece defining the respective drawing surface, that is the upper surface which is upwardly concave of the lower die and the lower surface with is downwardly convex of the upper die. It has been standard practice to make these dies so as to produce tubing elbows having arc lengths of 90°. When a tubing elbow of shorter arc length is needed a shorter plate is deep-drawn by the same die assembly, or a 90° elbow is cut down.

When it is necessary to use such a tubing elbow in a highly critical application, as in the cooling coil of a nuclear reactor, it is essential that a perfect weld or joint be formed between each end of the tubing elbow and the respective pipe. Such a perfect joint can normally be formed relatively easily with a 90° elbow, as the die is normally set up to produce a perfectly round cross section at each outer end of the elbow. When, however, an elbow of shorter arc length is needed, it is much more difficult to obtain the required perfect weld, as the cross section of the tubing elbow invariably varies somewhat from the perfectly circular throughout the length of the elbow.

Thus it is normally necessary to use separate individual dies for each tubing elbow of a different arc length. In normal practice this requires the manufacturer to have on hand for each pipe diameter a complete set of elbow dies. These dies are enormously expensive, as they are made of tool steel and must normally be machined and produced by hand, so that as a result the cost of tubing elbows produced thereby becomes quite elevated.

OBJECTS OF THE INVENTION

It is therefore an object of the present invention to provide an improved die assembly for making a tubing elbow.

Another object is to provide such a die assembly which can be used to produce tubing elbows of different arc lengths, but each having a perfectly circular or even cylindrical end.

SUMMARY OF THE INVENTION

These objects are attained, according to the instant invention, in a die assembly having upper and lower die halves each formed by a plurality of sections. More particularly the upper die half is constituted by an upper arcuate relatively long holder, a plurality of relatively short and arcuate upper die sections secured in an upper row to this upper holder and having arcuate and downwardly convex lower faces together forming an elongated and substantially continuous downwardly convex arcuate lower surface, and an upper end section at each end of the upper row and each having a generally semicylindrical downwardly convex face forming a continuation of the lower surface. The lower die half is complementarily formed of a lower arcuate relatively U-section holder, a plurality of short arcuate lower die sections having arcuate and upwardly concave upper faces together forming an elongated substantially continuous arcuate upper surface, and generally semicylindrical end sections having upwardly concave faces forming continuations of this upper surface. According to this invention each of the arcuate sections has an arc length equal to a whole-number fraction of 90°, for instance 15°, 30°, or 45°. The arc sections, therefore, together can be assembled to form an arc length of any standard size, and the end sections can be fitted in the respective holders at the ends of the rows of arc sections so that a single die can be set up to produce tubing elbows of any standard arc length. The upper and lower holders are set up so that the end sections can be mounted at any location therealong.

The system according to the instant invention has the further advantage that in the event one section or part of the die is damaged it is a relatively simple matter to replace it with a new one. The entire die need not be replaced, only the most wear-prone surfaces. Furthermore the die assembly according to this invention will always produce an extremely high-quality tubing-elbow half with perfectly dimensioned cylindrical ends, which latter are normally dimensioned to fit around the ends of the pipes they mate with, so that a good weld can be formed while a mechanically extremely rigid joint is ensured.

According to further features of this invention the lower die half, and in this context it should be noted that the terms "upper" and "lower" are merely used for the sake of convenience as it is entirely possible to use the assembly with the upper die half below the lower die half, is divided generally along its center line at least at the arcuate sections, and is provided with a bar having an upper bar face forming part of the upper surface of the lower die half. This bar is mounted on rods that extend through holes in the lower holder so that the bar can be moved toward and away from the upper die half. This bar serves the purpose of holding and guiding the plate during the initial stages of drawing. Thus the bar can move from an upper position generally level with the planar upper rim of the lower die half to a lower position wherein its upper face is continuous with the upper surface of the lower die half. This bar is urged upwardly with a force slightly smaller than the force with which the upper die half is forced downwardly into the lower die half. In this manner the plate positioned across the top of the die will first be pinched and slightly deformed between the bar and the upper die half, then pressed downwardly or tightly gripped between these two elements so that shifting of the plate during drawing is impossible. Furthermore such a bar is advantageously usable, after the workpiece plate has been drawn into the desired shape and the upper die half has been pulled out of the lower die half, to push out the drawn item which is normally relatively tightly wedged in the lower die half.

In accordance with another feature of this invention the die assembly is set up to produce tubing-elbow halves whose centerlines do not coincide with the centerline of the die assembly. This is achieved by providing off-center die sections and, if necessary, filler bodies between the die sections and the walls of the holder. In such an arrangement the lower holder is normally made with slots through which pass the actuating rods for the arcuate pressout bar. Thus the lower die half can be used for various types of tubing elbows.

The lower die half according to this invention is formed as a pair of L-section parts each having a lower leg generally coplanar with the lower leg of the other part and a pair of parallel upright side legs. Horizontal bolts extend between these parts and connect them rigidly together, thereby sandwiching the lower die sections between them. Releasing these bolts therefore allows the various die sections to be moved about or changed in accordance with the type of tubing-elbow half to be produced.

SPECIFIC DESCRIPTION

Figure 1:
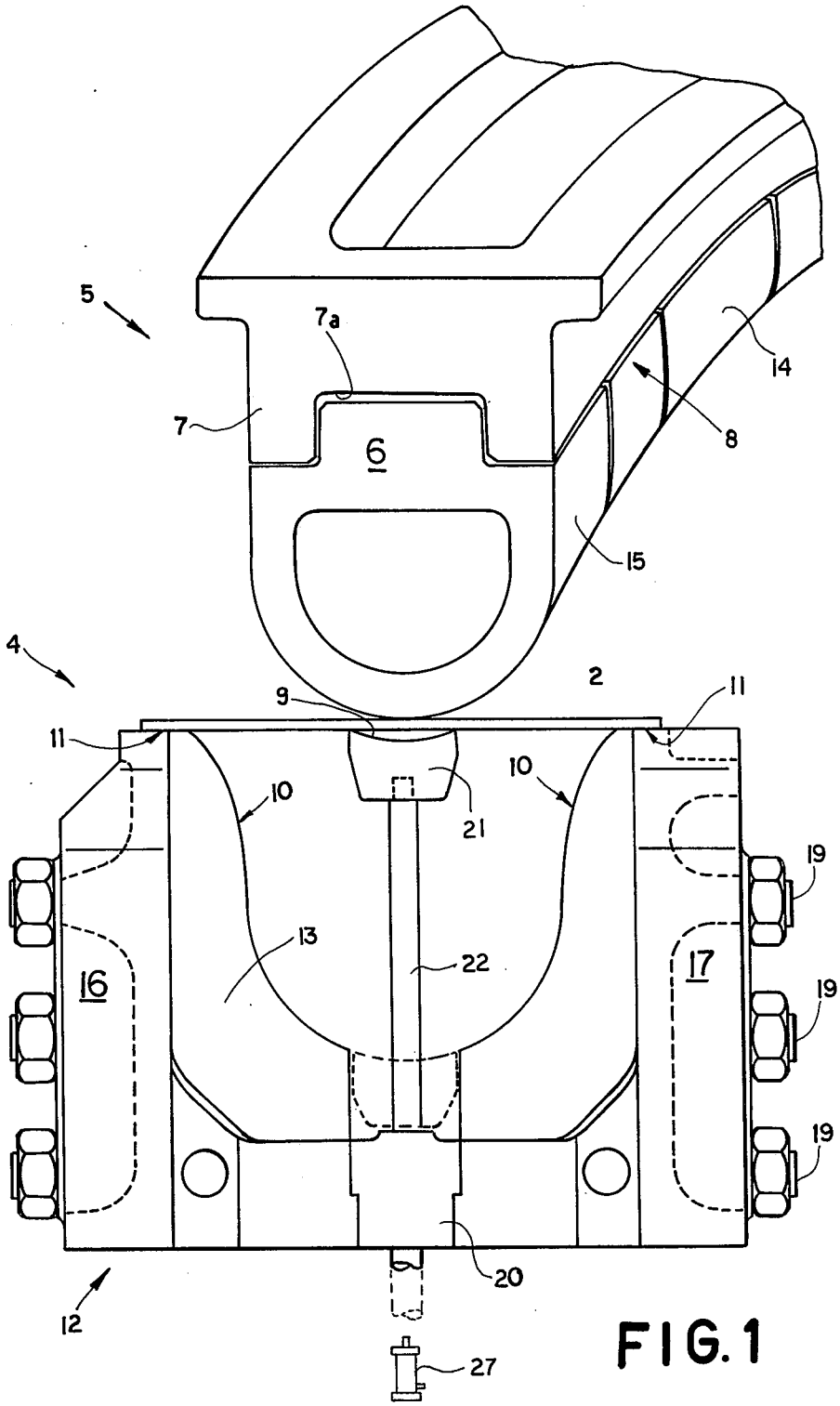
FIG. 1 is an end view of a die assembly according to this invention.
Figure 2:
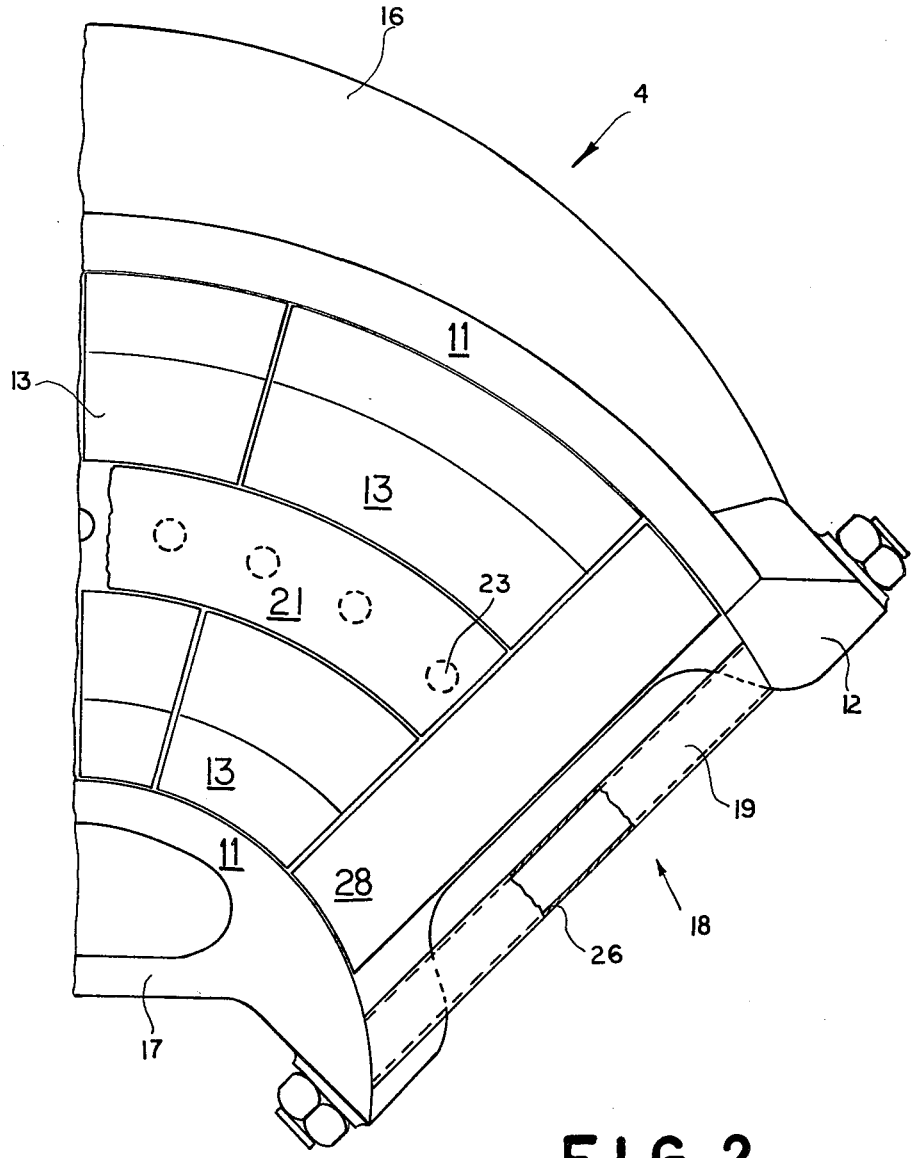
FIG. 2 is a top view of a portion of the die assembly of FIG. 1.
Figure 5:
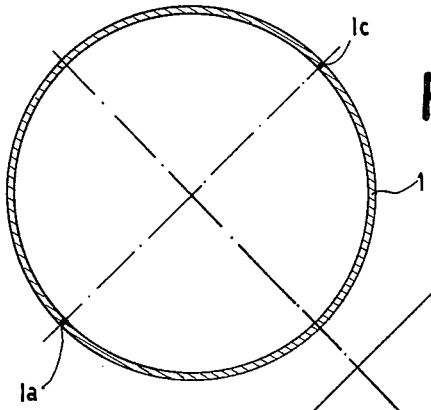
FIG. 5 is an end view of the tubing elbow of FIG. 4.
Figure 4:
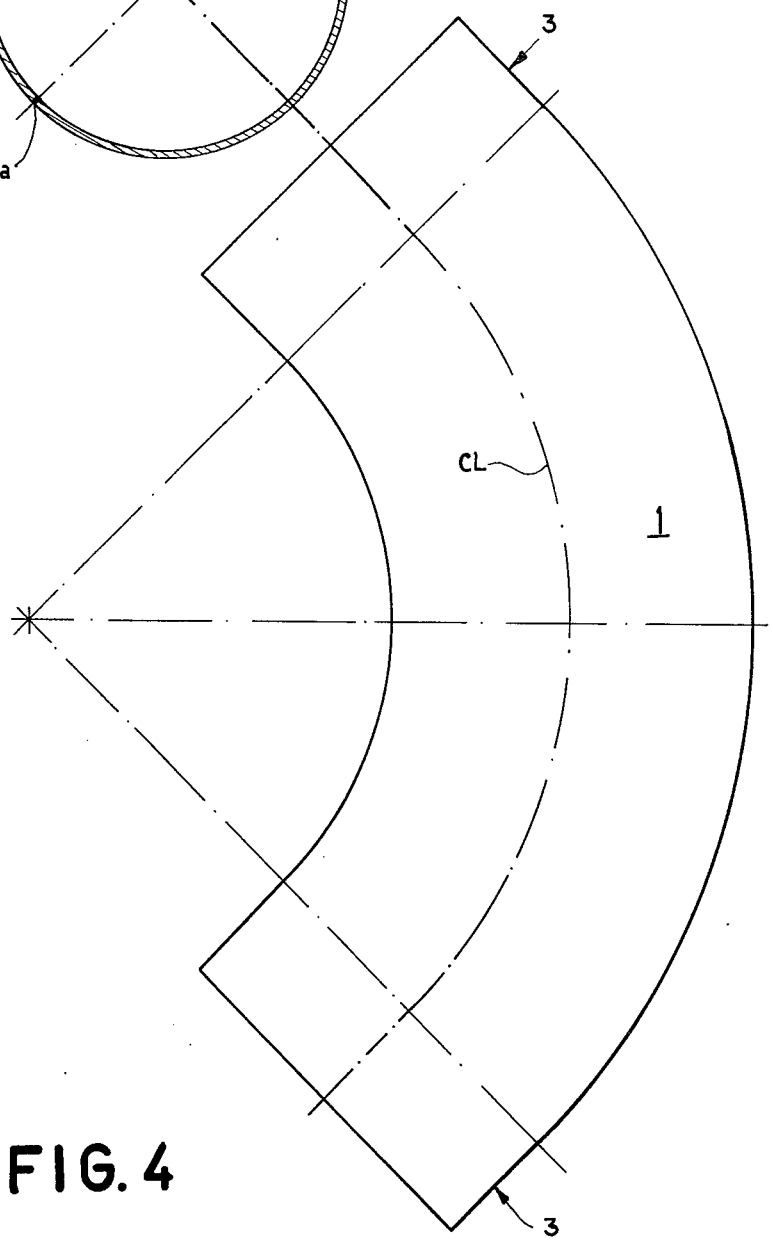
FIG. 4 is a top view of a tubing elbow produced according to the instant invention.

The assembly according to this invention is intended to manufacturing tubing elbows constituted of two identical halves 1 shown in FIGS. 4 and 5 from a flat plate 2 shown in FIG. 1. The elbow has a pair of cylindrical end sections 3 between which it has an arc length of 90° and a centerline CL. The two halves 1 are normally joined by welds 1*a*.

The die assembly as best shown in FIG. 1 basically comprises an upwardly concave lower die half 4 and a downwardly convex upper die half 5. Both parts 4 and 5 are adapted to be fitted to a conventional drawing press and are dimensioned so as to mate, leaving a space between them only equal to the thickness of the workpiece plate 2.

More particularly the upper die half 5 is formed by a lower forming portion 6 secured to an upper holder 7 having an arcuate and generally rectangular recess 7*a* receiving corresponding rectangular projections on the lower portion 6. This lower portion 6 forms a downwardly convex and arcuate surface 8 and is formed of a plurality of arcuate sections 14 and a pair of straight sections 15, the latter being of semicylindrical surface. Bolts which are not illustrated here secure the sections 14 and 15 snugly next to each other in the holder 7 so that the surface 8 is substantially continuous.

The lower die half 4 is constituted basically as a lower holder 12 formed of an inner L-section part 16 and an outer L-section part 17 between which is held a plurality of L-section segments or sections 13 forming an upwardly concave surface 10 complementary to the surface 8. The top of the holder 12 forms a planar rim 11 on which the workpiece plate 2 can rest.

Bolts 19 extend between the inner and outer side parts 16 and 17 all along the lower part 4 underneath the sections 13, and at the ends 18 even at the level of these sections, where they are provided with spacer tubes 26 that establish the spacing between the upright legs of the parts 16 and 17. These side parts 16 and 17 are furthermore bolted to either side of a spacer bar 20 formed with vertically throughgoing holes 23 through which pass rods 22 of a holding bar 21 extending arcuately through 90° and having an upper surface 9 constituting a smooth continuation of the surface 10 when the bar is in the lower dashed line position of FIG. 1. A hydraulic cylinder such as shown schematically at 27 is connected to the rods 22 and normally urges the bar 21 upwardly to but not beyond the illustrated solid-line position with a force equal to slightly less than the force with which the upper die half 15 is pressed downwardly during the drawing operation.

At the ends of the rows of inserts or arcuate sections 13 the lower die half 4 has sections 28 complementary to the sections 15 so as to form therewith the cylindrical end sections shown at 3 in FIG. 4. The bar 21 stops short of these end sections 28.

In use a plate 2 is set on the rim 11 and the cylinder 27 is pressurized to bring the bar 21 just barely into engagement with the lower surface of the plate 2. Then the upper die half 5 is moved downwardly until it contacts the plate 2 and deforms it slightly against the surface 9 of the bar 21. Further depression downwardly of the upper die half 5 will force the plate 2 with the bar 21 downwardly in the lower die half 4 until the plate 2 has a shape corresponding exactly to that of the surfaces 10 and 8, which are complementary. Thereafter the cylinder 27 is depressurized normally as the upper die half 5 is withdrawn, whereupon the cylinder 27 is repressurized to force the completed tubing half 1 out of the lower die half 4.

The die illustrated here is set up to form 90° elbows. As illustrated, however, one of the sections 14 and one of the sections 13 has an arc length of 45°, another has an arc length of 15°, and the third has an arc length of 30°. Thus together they have a combined arc length of 90°, but with suitable recombination and repositioning of the end sections 15 and 28 as well as replacement of the bar 21 it is possible to form shorter elbows having arc lengths of 30°, 45°, 60°, and 75°. For such changeover it is merely necessary to unbolt the sections 14 and 15 from the upper die half 5, then loosen the bolts 19 to rearrange the sections in the lower die half 4. Furthermore, should any of the sections become damaged during use or be worn excessively, it is possible to replace merely the damaged or worn section, while continuing to use the other sections. Thus a considerable saving in die costs is achieved.

Figure 3:
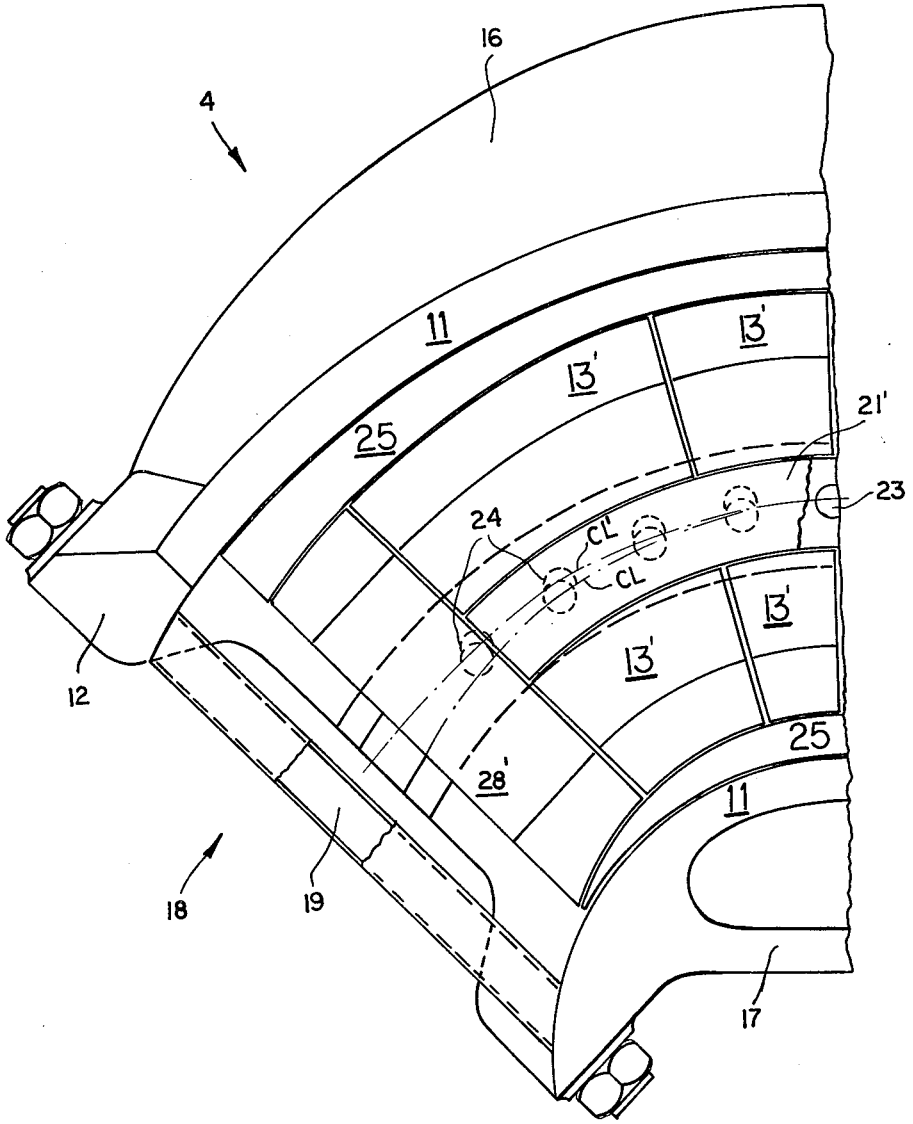
FIG. 3 is a top view similar to FIG. 2 but showing another die assembly according to this invention.

It is also possible as shown in FIG. 3 to employ arcuate die sections 13' and a different end section 28' in the lower die half 4, having a centerline CL' offset from the centerline of this die half 4. In this case the holes 23 are replaced by slots or elongated holes 24, and filler bodies 25 may be provided to either side of the sections 13' and 28'. Obviously in such a die assembly it is necessary to provide similarly off-center die sections in the upper die half.

I claim:

1. A die assembly for making a tubing elbow, said assembly comprising:

an upper die half including an upper arcuate relatively long holder, a plurality of relatively short and arcuate upper die sections secured in an upper row to said upper holder and having arcuate and downwardly convex lower faces together forming an elongated and substantially continuous downwardly convex arcuate lower surface, and an upper end section at each end of said upper row and each having a generally semicylindrical downwardly convex face forming a continuation of said lower surface; and a lower die half comprising a lower arcuate relatively long U-section holder, a plurality of relatively short and arcuate lower die sections secured in a lower row to said lower holder and having arcuate and upwardly concave upper surfaces together forming an elongated and substantially continuous upwardly concave arcuate upper surface, and a lower end section at each end of said lower row and each having a generally semicylindrical upwardly concave face forming a continuation of said upper surface, said upper sections being receivable within said lower sections.

2. The assembly defined in claim 1 wherein said lower holder includes inner and outer L-section holder parts having generally coplanar lower legs and generally parallel upright legs, and means spanning between and rigidly interconnecting said upright legs at the ends of said lower row.

3. The assembly defined in claim 2 wherein said lower arcuate sections each include outer and inner horizontally spaced lower section parts, said lower legs having confronting spaced-apart edges and said lower holder including a spacer between said confronting edges and at least generally following the arcuate centerline of said lower holder.

4. The assembly defined in claim 3 wherein said lower die half further includes an arcuate holding bar extending between said lower section parts and having an upper bar face forming part of said surface, said assembly further comprising means for displacing said bar toward and away from said upper die half.

5. The assembly defined in claim 4 wherein said bar has outer ends between said lower end sections, said lower end sections being generally U-shaped and unitary.

6. The assembly defined in claim 4 wherein said means for displacing said bar includes rods connected to said bar and extending downwardly through said lower holder, said lower holder being formed with throughgoing holes through which said rods pass.

7. The assembly defined in claim 1 wherein said surfaces are centered on respective surface centerlines and said holders have respective centerlines offset from the respective surface centerlines.

8. The assembly defined in claim 7, further comprising filler bodies between said holders and said sections.

9. The assembly defined in claim 7, further comprising in said lower die half an arcuate bar extending along said arcuate sections at the respective surface centerline and having an upper bar face forming part of said upper surface, and means for displacing said bar toward and away from said upper die half, said lower holder being formed with throughgoing slots elongated generally perpendicular of the respective centerlines, said means for displacing including rods extending through said slots.

10. The assembly defined in claim 1 wherein said halves have arc lengths between the ends of the respective rows substantially equal to 90°, said arcuate sections having arc lengths equal to 90°/n, n being a whole number from 2 through 6.

* * * * *